United States Patent [19]

Harland, deceased et al.

[11] 4,182,415

[45] Jan. 8, 1980

[54] TUBING STRING ROD RUNNING NIPPLE

[76] Inventors: Odis M. Harland, deceased, late of Casper, Wyo.; by Shirley J. Harland, executrix, 1615 Holly, Casper, Wyo. 82601

[21] Appl. No.: 921,222

[22] Filed: Jun. 30, 1978

[51] Int. Cl.[2] ..... E21B 33/03

[52] U.S. Cl. ..... 166/85; 166/315

[58] Field of Search ..... 166/80, 85, 88, 315, 166/343, 207

[56] References Cited

U.S. PATENT DOCUMENTS

| | | | |
|---|---|---|---|
| 1,944,545 | 1/1934 | Church | 166/80 |
| 1,983,854 | 12/1934 | Howard et al. | 166/80 |
| 2,010,992 | 8/1935 | Howard | 166/80 |
| 3,247,914 | 4/1966 | Slack | 166/362 |

*Primary Examiner*—James A. Leppink
*Assistant Examiner*—Richard E. Favreau
*Attorney, Agent, or Firm*—Clarence A. O'Brien; Harvey B. Jacobson

[57] ABSTRACT

An elongated tubular nipple is provided including upper and lower ends. The interior of the nipple defines a longitudinal bore extending therethrough and the lower and upper ends of the bore are downwardly and upwardly flared, respectively. The upper end portion of the nipple includes an externally threaded diametrically enlarged portion for threaded engagement within the internally threaded upper end of a tubular pumping tee mounted atop a tubing string section and the length of the nipple from the externally threaded diametrically enlarged portion to the lower end thereof is such to enable the nipple, when mounted within a pumping tee, to have its lower end at least closely adjacent the upper end of the tubing section from which the pumping tee is supported. The interior diameter of the nipple bore is of a size to substantially equal the interior diameter of the tubing string section from which the pumping tee is supported and the nipple serves to form an upward extension of the bore of the tubing string section through the pumping tee, whereby the sucker rod sections and scrappers or centralizers on the sucker rod sections may be guided as the sucker rod is being withdrawn from or downwardly inserted into the tubing string.

3 Claims, 3 Drawing Figures

TUBING STRING ROD RUNNING NIPPLE

BACKGROUND OF THE INVENTION

From time to time the sucker rods and pumps located at the bottom of an oil well need to be serviced. When service is to be performed, access to these units can be had only by withdrawing them from the well.

When the well is to be serviced, the stuffing box is first removed from the pumping tee and the sucker rods are then elevated out of the tubing string in order to withdraw the pump from the bottom of the well. As the sucker rods are withdrawn upwardly through the tubing string, the scrappers and centralizers attached to the sucker rods can engage the interior of the upper portion of the pumping tee and be damaged or knocked off the sucker rod. Accordingly, a need exists for structure whereby an upward extension of the interior of the uppermost tubing string section through the pumping tee may be provided. The nipple of the instant invention is downwardly telescopingly receivable within the pumping tee and movably threadingly supportable therefrom with the lower end of the nipple closely opposing and forming an upward continuation of the upper end of the tubing section upon which the pumping tee is mounted.

Various forms of guiding sleeves, and the like, for use in conjunction with oil well equipment and also for protecting the interiors of tubular members are disclosed in U.S. Pat. Nos. 3,056,427, 3,225,833, 3,459,270, 3,473,607 and 4,020,874.

BRIEF DESCRIPTION OF THE INVENTION

The nipple of the instant invention comprises an elongated tubular member having a smooth cylindrical bore formed longitudinally therethrough. The nipple is adapted to be utilized in upstanding position and the lower end of the nipple bore is downwardly flared while the upper end of the nipple bore is upwardly flared. The upper end portion of the nipple includes a first diametrically enlarged and externally threaded portion which is downwardly threadedly engageable within the internally threaded upper end of a pumping tee and the length of the nipple from the externally threaded upper end portion downwardly to the lower terminal end of the nipple is such that when the nipple is threadedly engaged within the internally threaded upper portion of a pumping tee, the lower end of the nipple will be positioned in alignment with and closely adjacent the uppermost tubing string from which the pumping tee is threadingly supported. Further, the upper terminal end of the nipple includes a second further diametrically enlarged and externally threaded upper end portion upon which a working table may be removably threadedly engaged after the nipple has been supported in position from the pumping tee.

The main object of this invention is to provide a tubular guide for use with conjunction with a pumping tee and as an upward continuation of the interior of the tubing string section to which the pumping tee is secured. In this manner, the sucker rod sections as well as the centralizers and scrappers supported from the sucker rod may be upwardly guided through the tee in order to prevent damage to the internal threads of the pumping tee at the upper end thereof and to also prevent damage to the centralizers or scrappers mounted on the sucker rod.

Another object of this invention is to provide a nipple which may be readily constructed of different diameters to be utilized in conjunction with different pumping tees.

Still another object of this invention is to provide a running nipple which may be constructed of different diameters and lengths so as to be adaptable for use in conjunction with different size pumping tees.

Still another object of this invention is to provide a pumping tee which will also facilitate the downward running of a sucker rod and the centralizers or scrappers supported therefrom.

A final object of this invention to be specifically enumerated herein is to provide a running nipple in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
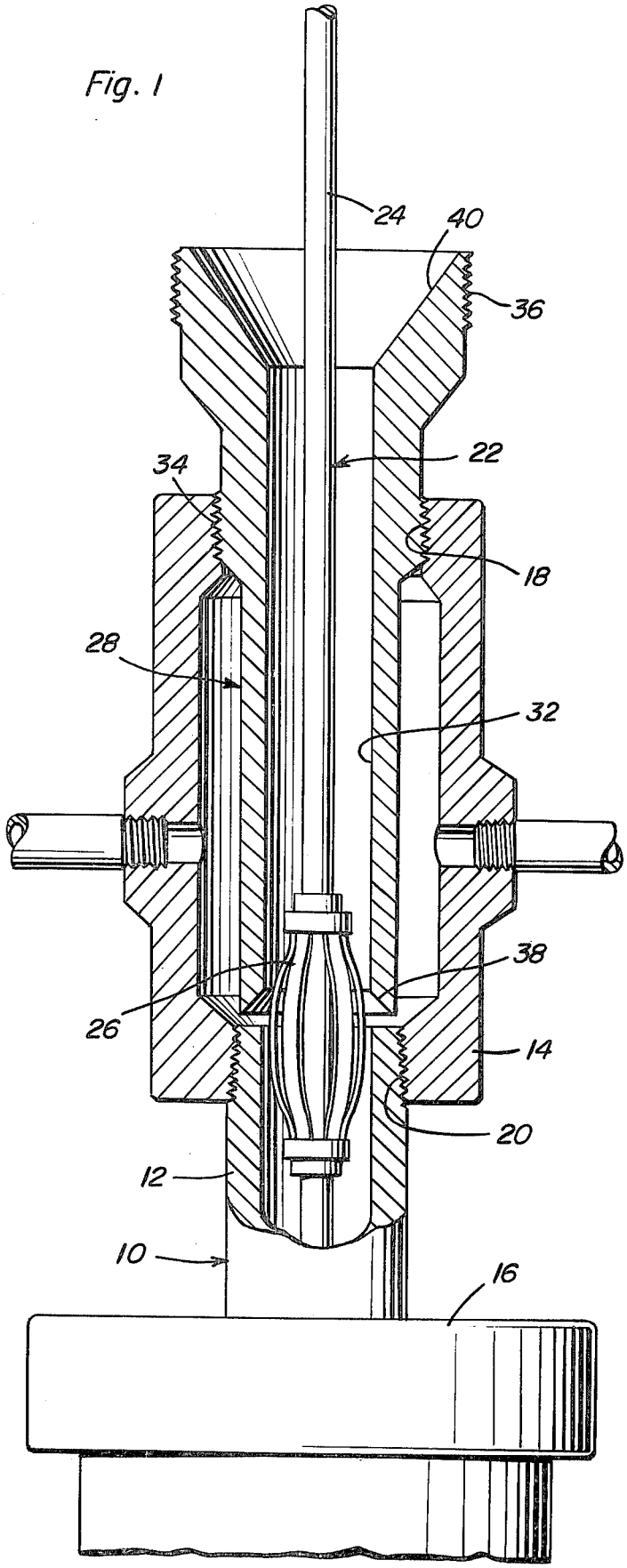
FIG. 1 is a fragmentary, vertical sectional view illustrating a pumping tee threadedly mounted upon the upper end of a tubing string and with the running nipple of the instant invention operatively associated with the pumping tee and uppermost tubing section.
Figure 2:
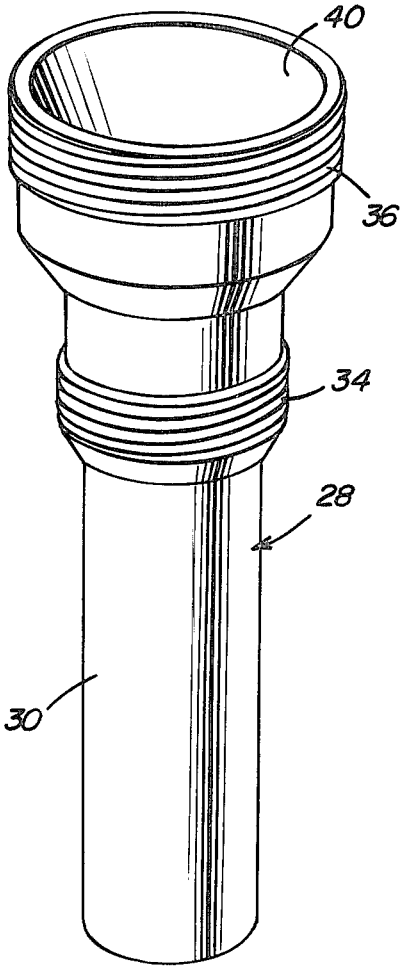
FIG. 2 is a perspective view of the running nipple.
Figure 3:
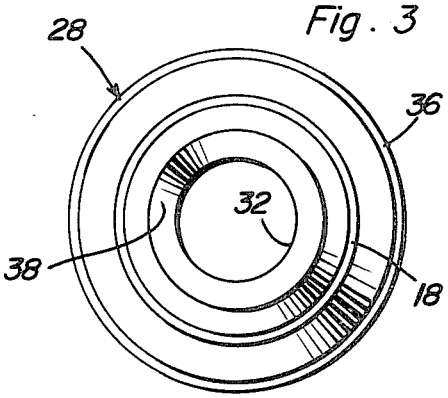
FIG. 3 is a bottom plan view of the running nipple.

Referring now more specifically to the drawings, the numeral 10 generally designates a tubing string including an uppermost tubing section 12 to which a conventional pumping tee 14 is threadedly mounted. The tubing section 12 projects upwardly through a tubing head 16 of a well and the interior of the pumping tee is hollow and includes an upper end threaded bore 18 registered with the lower end threaded bore 20 in which the externally threaded upper end of the tubing section 12 is threadedly engaged.

A sucker rod assembly referred to in general by the reference numeral 22 extends downwardly through the pumping tee and the tubing string 10 and includes a plurality of sucker rods 24 having centralizers and/or parafin scrappers 26 mounted thereon.

When it is desired to withdraw the sucker rod assembly 22 from the associated well, the assembly 22 is upwardly withdrawn from the well and the various centralizers or scrappers 26 pass outwardly from the upper end of the tubing section 12 and are then upwardly withdrawn through the upper threaded bore 18 of the pumping tee 14. Contact of the centralizers or scrappers 26 with the threads of the bore 18 may cause damage to the threads and also damage to the centralizers or scrappers 26. In addition, when the sucker rod assembly 22 is again lowered into the tubing string 10, contact of the centralizers or scrappers 26 with the threads of the bore 18 may also cause damage to the threads and also damage to the centralizers or scrappers 26. Further, contact of the scrappers or centralizers 26 with the threads of the bore 18 may cause the centralizers or scrappers 26 to be knocked from the sucker rod assembly 22 and to become jammed within the pumping tee 14.

The running nipple of the instant invention is referred to in general by the reference numeral 28 and comprises an elongated tubular member 30 having a central cylindrical bore 32 formed therethrough. The upper end portion of the tubular member 30 includes a first diametrically enlarged and externally threaded portion 34 and the upper terminal end of the tubular body 30 includes a second further diametrically enlarged and externally threaded terminal end 36.

When the nipple 28 is to be utilized in conjunction with tubing string sections 12 which are two inches in diameter, the bore 32 will be two inches in diameter, the over-all length of the nipple 10 will be approximately ten inches and the lower end portion of the nipple below the diametrically enlarged end portion 34 will be approximately four inches. The external diameter of the diametrically enlarged portion 34 will be approximately $3\frac{1}{2}$ inches and the external diameter of the diametrically enlarged upper terminal end 36 will be approximately $4\frac{1}{2}$ inches.

The lower end of the bore 32 includes a $\frac{1}{4}$ inch 30 degree chamfer 38 and the upper end of the bore 32 is chamfered approximately 15 degrees as at 40. Also, the external diameter of the lower end portion of the tubular member 30 is approximately $2\frac{3}{8}$ inches.

In operation, the nipple 28 is downwardly threaded into the bore 18 in a manner illustrated in FIG. 1 of the drawings. If it is desired, a working table (not shown) may then be threaded onto the diametrically enlarged upper terminal end 38 of the nipple 28. Thereafter, the sucker rod assembly 22 may be upwardly withdrawn from the associated well through the tubing string 10 and as the centralizers or scrappers 26 pass from the upper end of the tubing section 12 they will immediately be drawn into the chamfered lower end of the bore 32 for upward guiding of the centralizers or scrappers 26 through the pumping tee 14 in a manner positively preventing contact of the centralizers or scrappers 26 with the threads 18 and damaging the latter or the centralizers or scrappers 26. Of course, when the sucker rod assembly 22 is to be again lowered into the associated well, the nipple 28 remains in place and serves to guide the sucker rod assembly 22 downwardly through the pumping tee 14. Of course, as each centralizer of scrapper 26 is lowered into the nipple 20, it is guided therethrough pass the thread 18 and into the upper end of the uppermost tubing section 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a well tubing string including an upper tubing string section, a tubular pumping tee having internally threaded upper and lower vertically spaced and registered bores as well as a central interior into which said bores open of transverse interior dimensions greater than the diameters of said bores, the upper end of said upper section being externally threaded and threaded into said lower bore, an upstanding tubular running nipple having open upper and lower ends and defining an upstanding cylindrical bore extending therethrough of a diameter substantially equal to the inside diameter of said section, the lower end of said nipple being loosely telescoped downwardly into said tee through said upper bore with the lower end of said cylindrical bore aligned with and positioned at least closely adjacent the upper end of said section, the upper end portion of said nipple including a diametrically enlarged externally threaded portion removably threaded in said upper bore, the upper end of said cylindrical bore being chamfered so as to be upwardly flared.

2. The combination of claim 1 wherein the lower end of the interior of said nipple is outwardly flared.

3. The combination of claim 1 wherein said nipple includes a further diametrically enlarged and externally threaded upper terminal end above the first mentioned diametrically enlarged portion adapted to have a working table threadingly mounted thereon above said tee.

* * * * *